US011530698B2

(12) United States Patent
Saito et al.

(10) Patent No.: US 11,530,698 B2
(45) Date of Patent: Dec. 20, 2022

(54) OIL PUMP INCLUDING RESIN PUMP COVER

(71) Applicant: YAMADA MANUFACTURING CO., LTD., Kiryu (JP)

(72) Inventors: Yuken Saito, Kiryu (JP); Manabu Watanabe, Kiryu (JP); Tomonori Yahagi, Kiryu (JP)

(73) Assignee: YAMADA MANUFACTURING CO., LTD., Kiryu (JP)

( * ) Notice: Subject to any disclaimer, the term of this patent is extended or adjusted under 35 U.S.C. 154(b) by 0 days.

(21) Appl. No.: 17/367,166

(22) Filed: Jul. 2, 2021

(65) Prior Publication Data

US 2022/0074406 A1 Mar. 10, 2022

(30) Foreign Application Priority Data

Sep. 7, 2020 (JP) ..... JP2020-149938

(51) Int. Cl.
*F04C 2/10* (2006.01)
*F04C 2/08* (2006.01)
*F04C 15/00* (2006.01)

(52) U.S. Cl.
CPC ..... *F04C 2/102* (2013.01); *F04C 2/084* (2013.01); *F04C 2/10* (2013.01); *F04C 15/00* (2013.01); *F04C 15/0026* (2013.01); *F04C 2210/206* (2013.01); *F04C 2240/30* (2013.01); *F04C 2240/60* (2013.01); *F05C 2253/20* (2013.01)

(58) Field of Classification Search
CPC ..... F04C 2/10–102; F04C 18/10–103; F04C 2240/30; F04C 2210/206; F01C 1/10–103
See application file for complete search history.

(56) References Cited

U.S. PATENT DOCUMENTS

2016/0138591 A1* 5/2016 Ma ..... F04C 14/22 418/19
2020/0300241 A1* 9/2020 Lu ..... F04C 2/10

FOREIGN PATENT DOCUMENTS

JP H10-047259 A 2/1998
JP 2007002691 A * 1/2007

* cited by examiner

*Primary Examiner* — Laert Dounis
(74) *Attorney, Agent, or Firm* — McGinn I.P. Law Group, PLLC.

(57) ABSTRACT

An oil pump is configured to include a rotor, a drive shaft that drives the rotor to rotate, a rotor chamber in which the rotor is contained, an inlet port and an outlet port each provided in the vicinity of the rotor chamber, and a pump cover. The pump cover is made of a resin. On a portion of an outer surface side of the pump cover corresponding to an inner portion, in which oil circulates, of the pump cover, a rib that has an erecting wall shape is provided.

10 Claims, 6 Drawing Sheets

Fig.2A
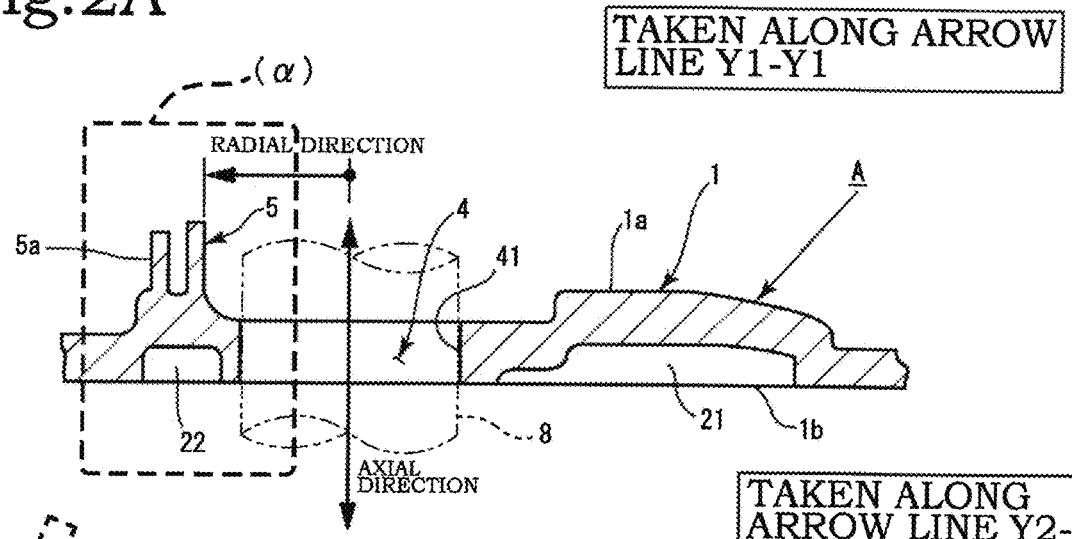
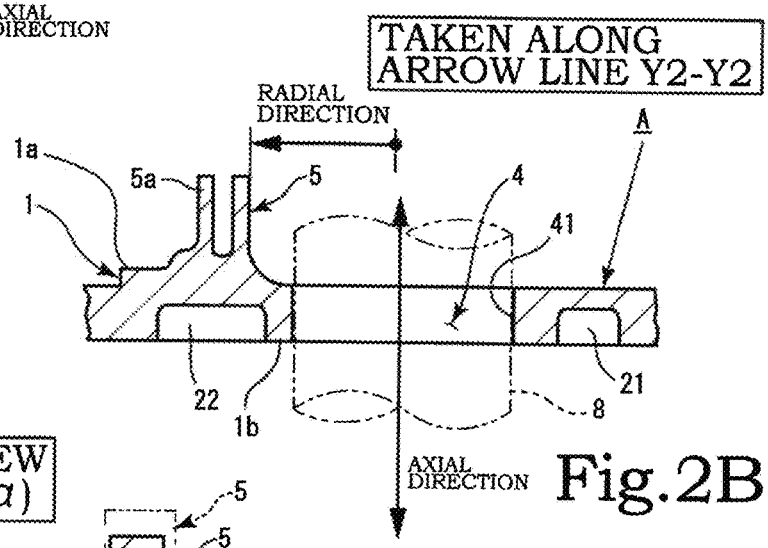
Fig.2B
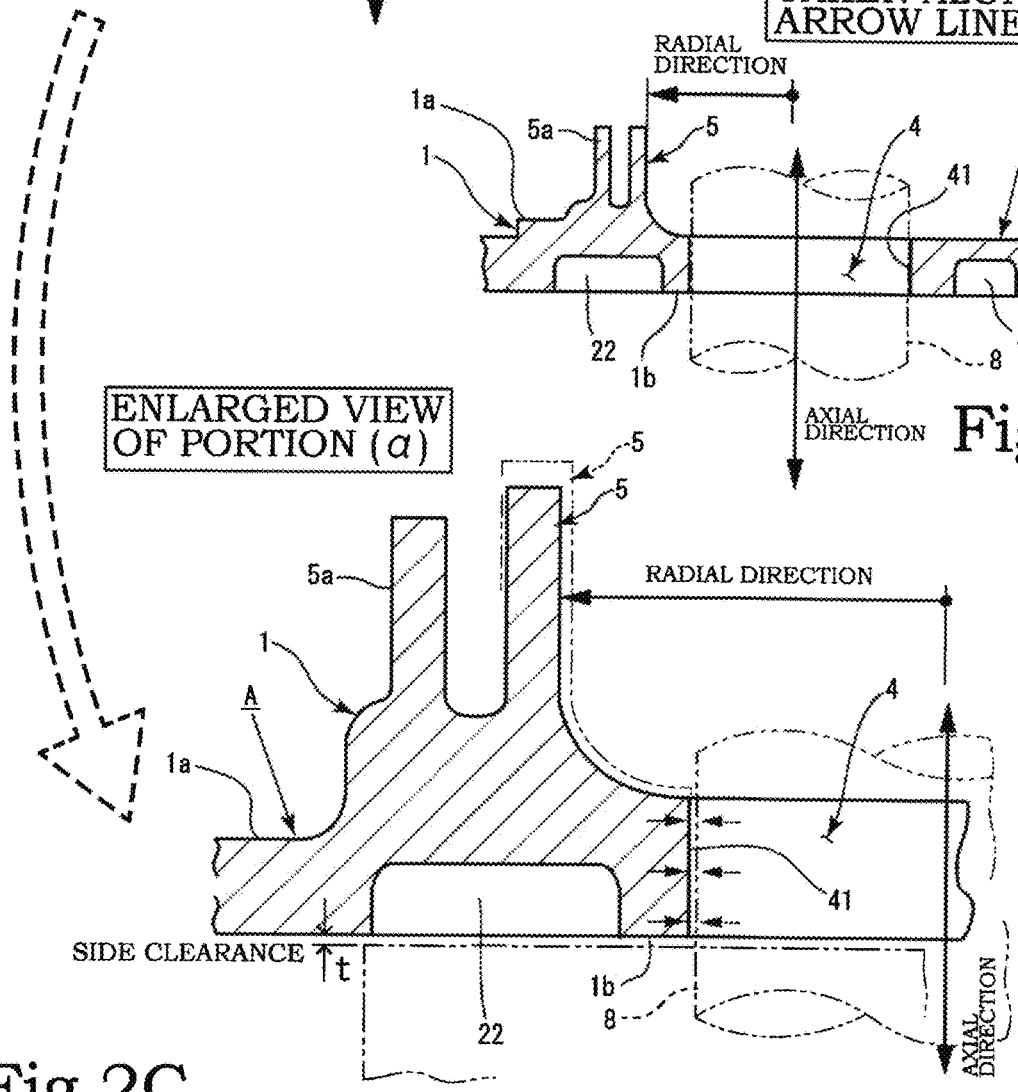
Fig.2C

OIL PUMP INCLUDING RESIN PUMP COVER

BACKGROUND OF THE INVENTION

1. Field of the Invention

The present invention relates to an oil pump which includes a pump cover made of a resin, and which allows a side clearance between a rotor and the pump cover to be constantly maintained in an optimum state without being affected by a temperature and a pressure of oil.

2. Description of the Related Art

In an oil pump that supplies oil to a lubrication system of an automobile or the like, to achieve an object of reducing a weight of an entire device, a light-weight material tends to be used. Accordingly, an aluminum alloy, which is a light-weight metal, has been increasingly used. However, to achieve a lighter weight, a resin may be used as a constituent member.

In recent years, resins have improved performance, and there are reinforced resins having durability. For constituent members, a resin and a metal are selectively used in many cases. In an oil pump, members required to have strengths such as an inner rotor, an outer rotor, and a drive shaft of, e.g., an internal gear type rotor, may be each made of a metal, while a pump cover required to have a strength not so high as those required of the abovementioned members may be made of a resin. By doing so, it is possible to not only generally reduce a weight of the entire oil pump, but also further improve a productivity (see Japanese Patent Application Publication No. H10-47259).

SUMMARY OF THE INVENTION

When, in particular, an oil pump is used for oil lubrication in an engine, a transmission, or the like of an automobile, an environment in which the oil pump is used is in extremely tight conditions under which various loads such as a temperature and a pressure of oil are placed on the oil pump. Among the constituent members of the oil pump, the resin member and the metal member have extremely different properties and, accordingly, the temperature and pressure of the oil mentioned above exert significantly different influences on the resin member and the metal member.

Consequently, the resin member and the metal member undergo significantly different shape changes due to an oil temperature difference and the oil pressure serving as the loads. In the oil pump, when a pump cover is made of a resin and each of a rotor and a drive shaft of the rotor is made of a metal, an insertion portion for the drive shaft is provided in, e.g., the pump cover, and the drive shaft extends through the insertion portion of the pump cover. Here, an inner diameter of the insertion portion and an outer diameter of the drive shaft are set to have appropriate design values. However, as is obvious, the insertion portion and the drive shaft have different thermal expansion coefficients and different Young's moduli and, needless to say, the temperature and the pressure of the circulating oil vary during an operation of the oil pump.

Around the insertion portion of the pump cover, an inlet port and an outlet port are provided, and an oil pressure difference is produced between the two ports. Consequently, the pressure is higher on an outlet port side than on an inlet port side. Since the pump cover made of the resin has the thermal expansion coefficient and the Young's modulus which are higher than those of the rotor made of the metal, a gap in an axial direction formed between the pump cover and the rotor, i.e., a side clearance, tends to vary.

As the temperature and the pressure of the oil increase, a size to of the side clearance between the pump cover and the rotor increases only by an increment k due to thermal expansion, the pressure, and the like (see FIG. 6). In other words, the gap formed therebetween is enlarged. As a result, oil leakage occurs, and the increased temperature and the increased pressure of the oil degrade characteristics of the oil pump. FIG. 6 illustrates a related art technique, in which a reference mark a denotes a pump cover, a reference mark b denotes a rotor, and a reference mark c denotes a drive shaft.

To eliminate such a disadvantageous situation, it is conceivable to use means which increases a thickness of the entire pump cover to minimize an amount of the deformation due to the oil temperature and the oil pressure. However, to avoid the disadvantageous situation described above, it is required that a thickness amount of the pump cover is, e.g., 1.5 times larger than that when the pump cover is made of a metal, though depending on a material thereof. This prevents an effect achieved by the pump cover made of the resin to reduce a weight of the entire device from being obtained. It is therefore an object of the present invention to provide a pump cover made of a resin with a highly rigid structure and thereby solve the problem described above.

To solve the problem described above, the present inventors have conducted vigorous study and consequently solved the problem described above by providing an oil pump according to a first aspect of the present invention including: a rotor; a drive shaft that drives the rotor to rotate; a rotor chamber in which the rotor is contained; an inlet port and an outlet port each provided in the vicinity of the rotor chamber; and a pump cover. The pump cover is made of a resin. On a portion of an outer surface side of the pump cover corresponding to an inner portion, in which oil circulates, of the pump cover, a rib that has an erecting wall shape is provided.

The present inventors have solved the problem described above by providing an oil pump according to a second aspect of the present invention corresponding to the oil pump according to the first aspect in which the rib is formed along a shape of the outlet port. The present inventors have solved the problem described above by providing an oil pump according to a third aspect of the present invention corresponding to the oil pump according to the first aspect in which the rib is formed on the portion corresponding to a range disposed at a radial middle portion of the outlet port and extending, along a direction of the rotation of the rotor, to the vicinity of a terminal end of the outlet port or to the vicinity of a beginning end of the inlet port.

The present inventors have solved the problem described above by providing an oil pump according to a fourth aspect of the present invention corresponding to the oil pump according to the first aspect in which the rib is formed to extend gradually radially away from a periphery of an insertion portion which is disposed at a radial middle portion of the outlet port and through which the drive shaft is inserted, and a portion of the rib extending away has a linear shape. The present inventors have solved the problem described above by providing an oil pump according to each of fifth, sixth, seventh, and eighth aspects of the present invention corresponding to each of the oil pumps according to the first, second, third, and fourth aspects in which, on an outer peripheral side or an inner peripheral side of the rib, an auxiliary rib having a length, in a direction of the rotation, which is shorter than that of the rib is formed to be radially spaced apart by a predetermined distance from the rib.

In the present invention, the oil pump is made of the resin and configured such that, on the portion of the outer surface side of the pump cover corresponding to the inner portion of the pump cover in which the oil circulates, the rib having the erecting wall shape is provided. Consequently, when a temperature and a pressure of the oil circulating in the oil pump increase, an external force is generated due to a thermal expansion force, a pressure, or the like exerted in a direction in which the pump cover is enlarged toward the outer surface side. However, the rib described above receives such an external force to prevent the pump cover from being enlarged toward the outer surface side thereof. Thus, it is possible to appropriately maintain a shape of the pump cover made of the resin, maintain a side clearance between the rotor and the pump cover in an appropriate state, and maintain excellent ejection performance.

BRIEF DESCRIPTION OF THE DRAWINGS

FIG. 2A is an end view taken along an arrow line Y1-Y1 in FIG. 1A, FIG. 2B is an end view taken along an arrow line Y2-Y2 in FIG. 1A, and FIG. 2C is an enlarged view of a portion (a) in FIG. 2A;

DESCRIPTION OF THE PREFERRED EMBODIMENTS

Figure 4:
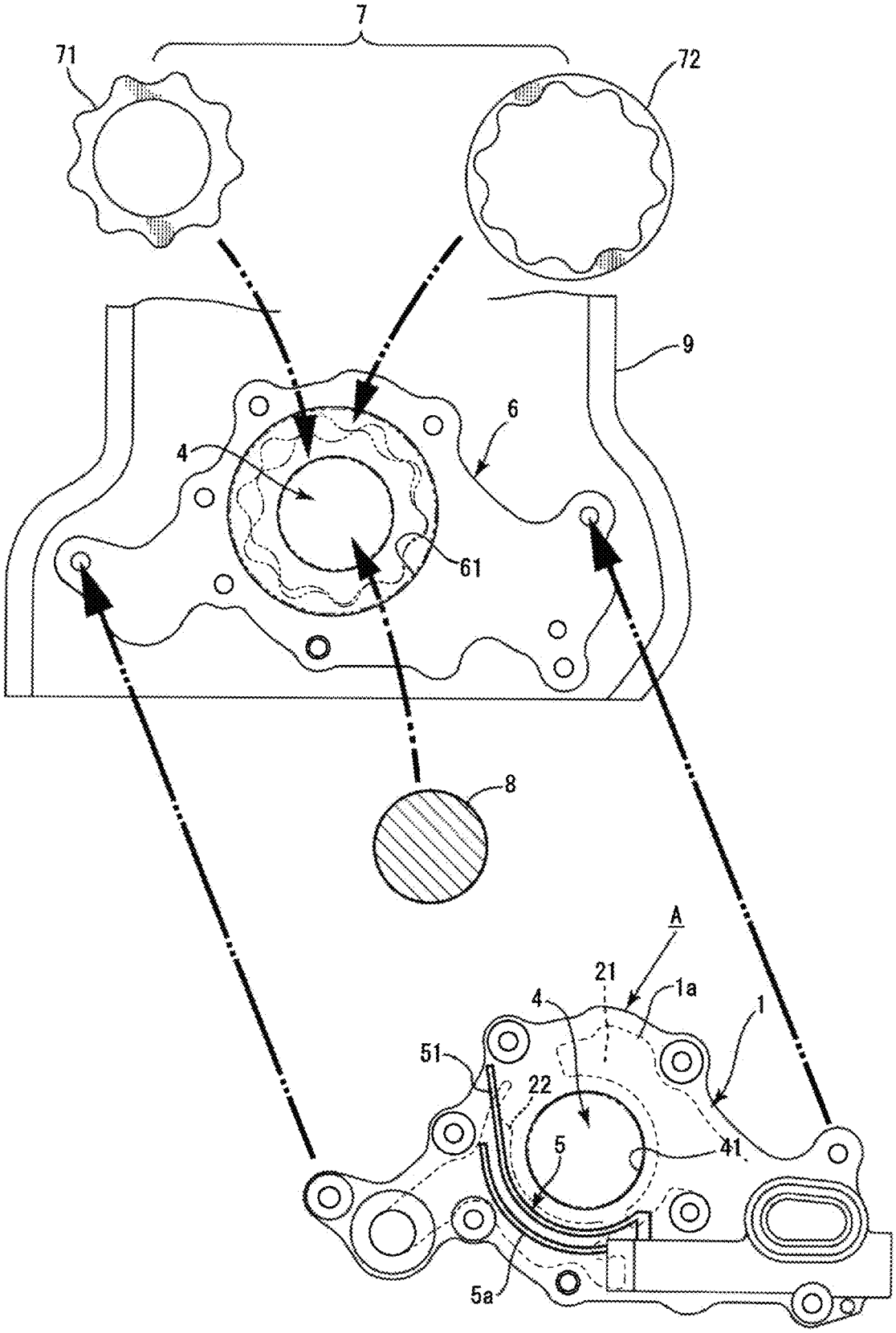
FIG. 4 is an exploded view illustrating a configuration of the present invention.

The following will describe an embodiment of the present invention with reference to drawings. An oil pump in the present invention is attached appropriately to a device that requires lubricant oil, such as a transmission or an engine. A configuration of the present invention mainly includes a pump cover A, a drive shaft 8, and a rotor 7 (see FIGS. 1A, 1B, and 4).

Note that a description given in the present invention uses an axial direction and a radial direction each indicating a direction. The axial direction refers to a direction along an axial length of the drive shaft 8 when the drive shaft 8 is appropriately attached to the pump cover A and to a pump housing 6. The axial direction is also used in common for a member other than the drive shaft 8 as wording indicating a direction based on the drive shaft 8 in a state where the drive shaft 8 is appropriately attached. The axial direction is indicated by an arrow in each of the main drawings. The radial direction refers to a direction perpendicular to the axial direction.

The pump cover A of the oil pump in the present invention is made of a resin and, as a specific material, a phenol resin is used appropriately. The pump cover A has a cover main body 1, and the cover main body 1 has an inner surface side 1*b* corresponding to an inner side of the oil pump and an outer surface side 1*a* corresponding to an outer side of the oil pump. On the inner surface side 1*b* of the cover main body 1, a side surface of a rotor chamber 11, an inlet port 21, an outlet port 22, a relief valve housing 24, and the like are provided. On the outer surface side 1*a* of the cover main body 1, a rib 5 described later is provided. In the cover main body 1, an insertion portion 4 is further formed to extend through the cover main body 1 between the inner surface side 1*b* and the outer surface side 1*a*. Through the insertion portion 4, a drive shaft 8 described later extends. Alternatively, there may be a case where the drive shaft 8 described later is inserted through the pump housing 6, and the insertion portion 4 is not formed in the cover main body 1.

The pump housing 6 is provided together with the pump cover A as a single body. Alternatively, the pump housing 6 is configured to be integrally molded with a casing of an oil circulation mechanism unit such as an engine, and the pump cover A having the rotor and the drive shaft each attached thereto is attached to an engine casing 9. The pump housing 6 has substantially the same shape as an outer shape of the pump cover A. Note that a reference numeral 41 seen in FIGS. 1A, 1B, 2A to 2C, and the like denotes an inner peripheral side surface of the insertion portion 4.

Figure 1A:
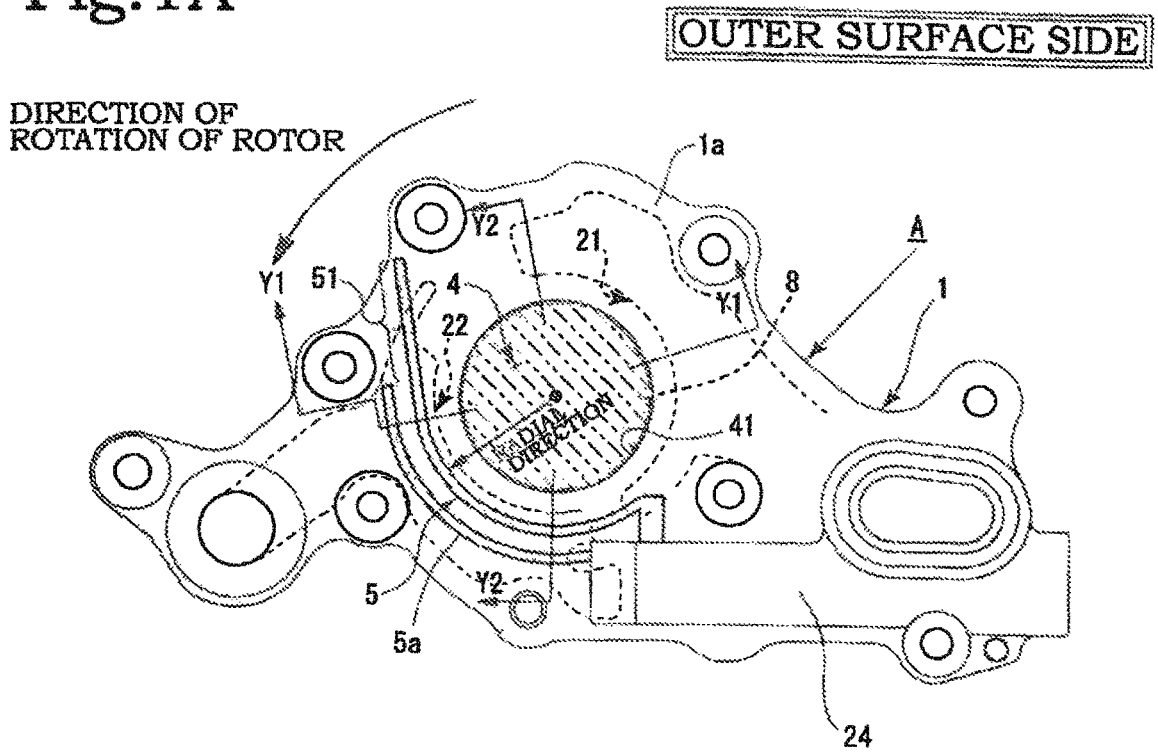
FIG. 1A is an external view of a pump cover in the present invention and FIG. 1B is an internal view of the pump cover.
Figure 1B:
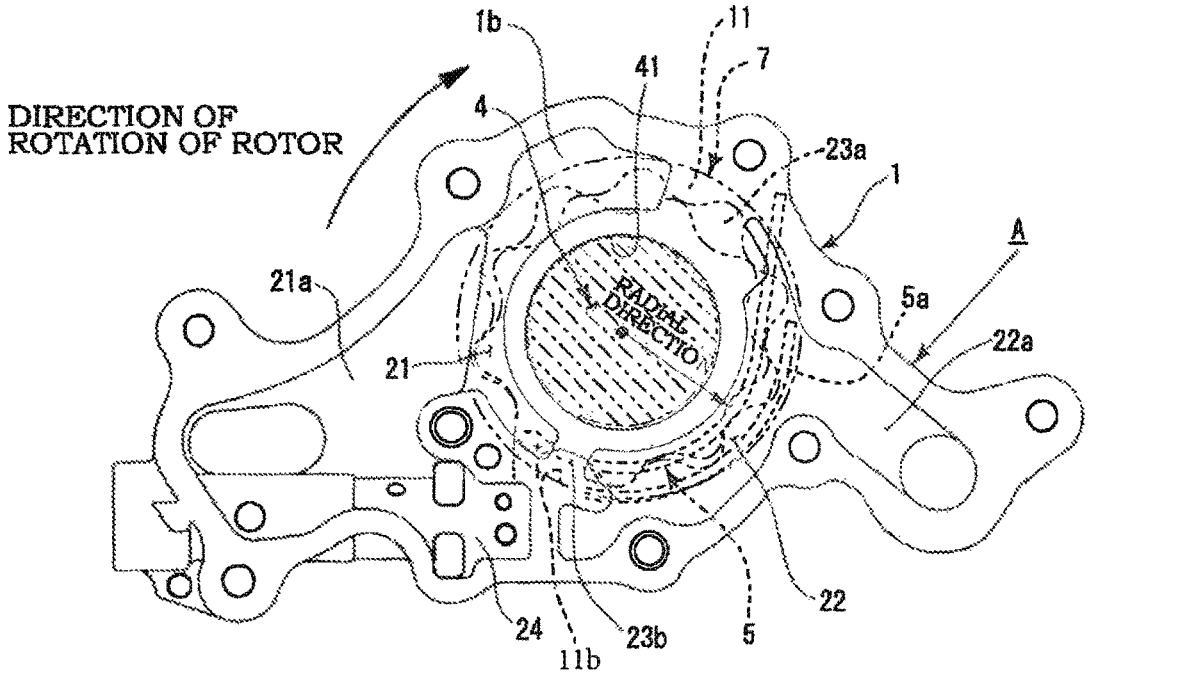

The insertion portion 4 of the pump cover A is provided in a side surface portion of the rotor chamber 11 (see FIG. 1B). The rotor chamber 11 is a portion provided in the pump housing 6 to contain therein the rotor 7 described later. The rotor chamber 11 has a circumferential inner peripheral side surface 11*b*. The inner peripheral side surface 11*b* needs not necessarily be a circumferentially continuous wall surface, and is configured as a discrete arcuate wall surface (see FIG. 1B). In the rotor chamber 11, the inlet port 21 and the outlet port 22 are present outside the insertion portion 4 in the radial direction. The inlet port 21 includes an intake flow path 21*a* for oil, while the outlet port 22 includes an ejection flow path 22*a* for the oil (see FIG. 1B).

The pump housing 6 is integrated with the engine casing 9. The pump housing 6 is formed during manufacturing of the engine casing 9. In an assembly factory, the pump cover A is connected to the pump housing 6 to produce the oil pump (see FIG. 4). Accordingly, the name of the pump cover A may also be substituted by the name of the pump housing 6. In this case, the name of the pump housing 6 is substituted by the name of the pump cover A.

Figure 3A:
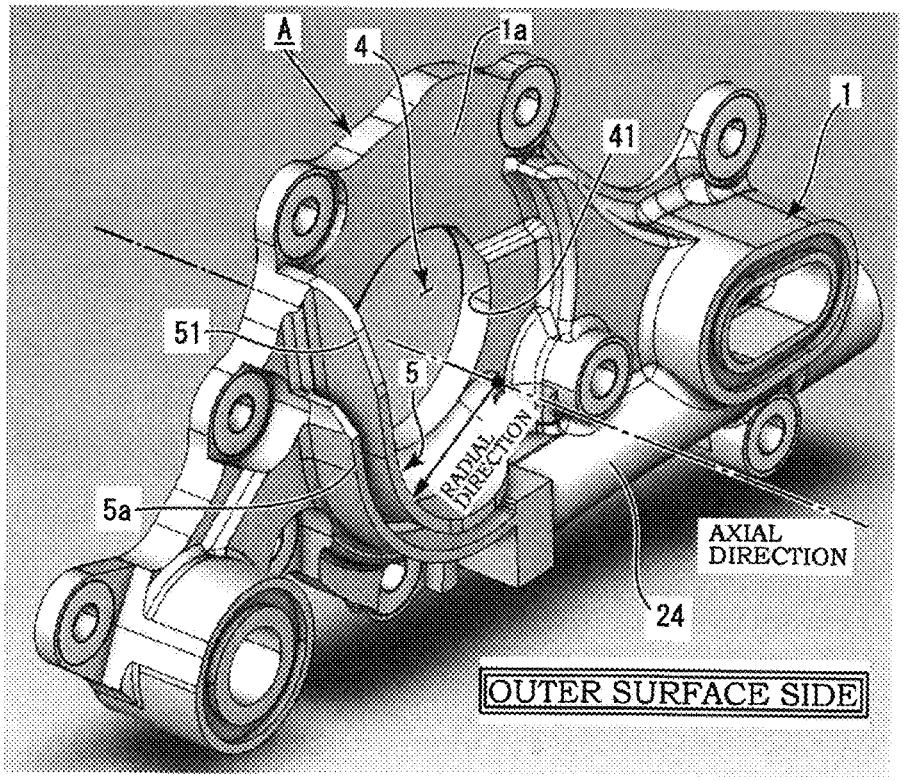
FIG. 3A is a perspective view of the pump cover in the present invention and FIG. 3B is an external view of the pump cover in another embodiment of the present invention.

On the outer surface side 1*a* of the pump cover A made of the resin, the rib 5 (see FIGS. 1A, 3A, and 3B) is formed. The rib 5 is provided on a portion of the outer surface side 1*a* which is in the vicinity of a hole of the insertion portion 4 and corresponds to a portion of the pump cover A in which the oil circulates. The rib 5 is formed into a wall shape vertically erecting from the outer surface side 1*a* of the pump housing 6. On the portion of the pump cover A in which the oil circulates, a pressure is exerted by the oil and, at the same time, a temperature of the circulating oil gradually increases to a high level.

Due to the high temperature/high pressure of the oil, a load acts on the pump cover A to vary a side clearance between the pump cover A and the rotor 7. A gap t of the side clearance between the rotor 7 and the pump cover A tends to be enlarged. As a result, when the gap t of the side clearance exceeds a given value, oil leakage occurs to degrade pump efficiency. In the present invention, the pump cover A is made of the resin and, accordingly, at a place where each of the temperature and the pressure of the oil increases, a force due to thermal expansion and an ejection pressure causes deformation of the pump cover A (see FIG. 2C). At this time, the rib 5 present on the outer surface side 1*a* counteracts a force to enlarge the pump cover A and prevents the enlargement.

The portion in which the oil circulates described above corresponds to each of the inlet port 21 and the outlet port 22. The pressure of the circulating oil particularly increases in the outlet port 22. Accordingly, on the outer surface side 1*a* of the pump cover A corresponding to the outlet port 22, the rib 5 is formed (see FIGS. 1A, 1B, and 2A to 2C). The rib 5 is formed on the outer surface side 1*a* of the pump cover A corresponding to a range disposed at a radial middle portion (including also a substantially middle portion and the vicinity of the middle portion or a periphery) in a region connecting a beginning end and a terminal end of the outlet port 22 and extending along a direction of rotation of the rotor 7 to the vicinity of a beginning end of the inlet port 21 or to the vicinity of the terminal end of the outlet port 22.

At this time, between the terminal end of the outlet port 22 and the beginning end of the inlet port 21, a second seal land (partitioning portion) 23*b* is provided and, on the outer surface side 1*a* of the pump cover A corresponding to the second seal land 23*b* also, the rib 5 may continuously be provided. Meanwhile, between the beginning end of the outlet port 22 and a terminal end of the inlet port 21, a first seal land (partitioning portion) 23*a* is provided. A range of the rib 5 corresponds to a portion of the inner surface side 1*b* of the pump cover A in which the oil pressure is highest. As a result, the rib 5 on the outer surface side 1*a* of the pump cover A made of the resin is deformed by loads placed by thermal expansion due to the temperature of the oil and by the high pressure of the oil. Thus, the rib 5 undergoes the deformation due to such loads (see FIG. 2C).

In particular, the rib 5 of the pump cover A is made of the resin, similarly to the cover main body 1. In addition, the rib 5 has a wall shape vertically erecting from the outer surface side 1*a* of the pump cover A (see FIGS. 2A to 2C and 3A). As a result, the rib 5 having the erecting wall shape thermally expands/contracts mainly in the axial direction to expand in the vertical direction and can also absorb the load due to the high pressure of the oil in the axial direction. Therefore, it is possible to maintain an appropriate side clearance.

Next, there is an embodiment in which the rib 5 is disposed at a radial middle portion (including also a substantially middle portion and the vicinity of the middle portion or a periphery) in an extending direction of the outlet port 22 and formed to extend gradually radially away from a periphery of the insertion portion 4, and the portion of the rib 5 extending away from the insertion portion 4 serves as a linear rib segment 51 having a linear shape (see FIGS. 1A and 2A). In this embodiment, the rib 5 gradually radially extends away from the insertion portion 4 with a variation of the ejection pressure on the outlet port 22 side to allow the linear rib segment 51 to hold the side clearance uniform.

Next, there is also an embodiment in which an auxiliary rib 5*a* is formed on a radially outer peripheral side of the rib 5 to be spaced apart by a predetermined distance from the rib 5 (see FIGS. 1A and 2A). The auxiliary rib 5*a* is disposed to be radially spaced apart from the rib 5 substantially in parallel relation therewith. The auxiliary rib 5*a* is provided in a range shorter in the extending direction than that of the rib 5. Each of the auxiliary rib 5*a* and the rib 5 can individually absorb the load (external force). Consequently, it is possible to reduce a height of the rib 5 from the outer surface side 1*a* and reduce a height of a combination of the rib 5 and the auxiliary rib 5*a*.

Figure 3B:
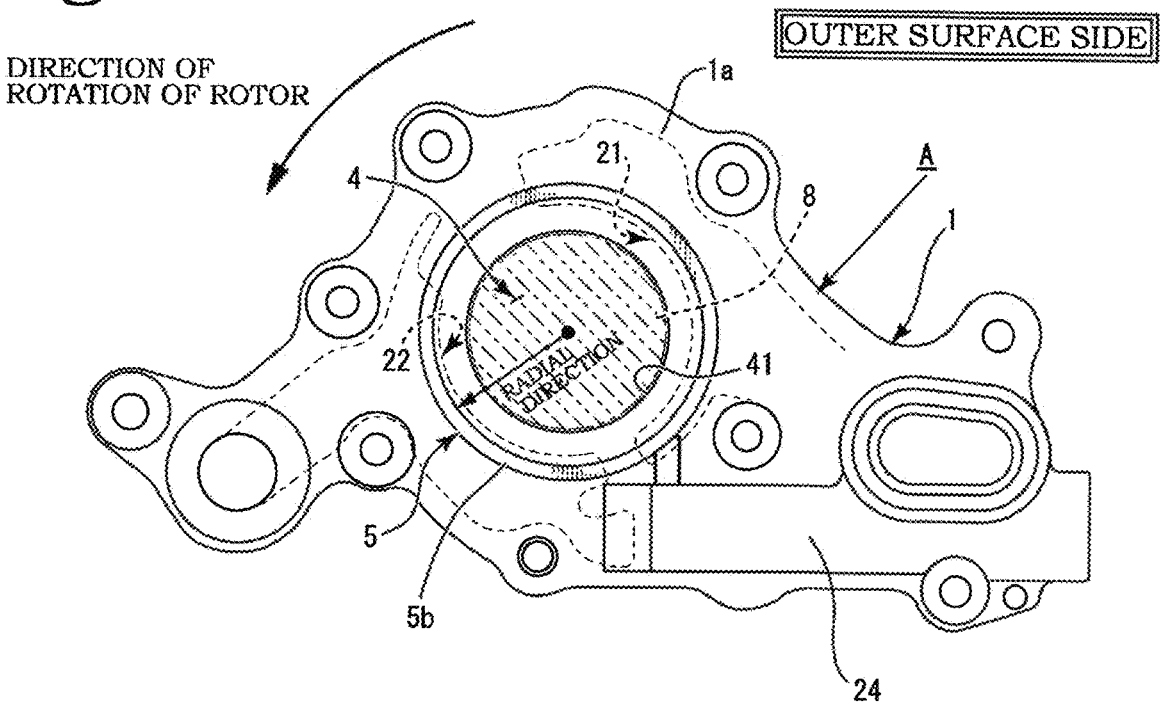

There is also an embodiment in which the rib 5 is provided as an annular rib segment 5*b* formed annually around the insertion portion 4 (see FIG. 3B). The annular rib segment 5*b* is a substantially annular rib segment provided continuously to a basic portion of the arcuate rib 5 that does not include the linear rib segment 51 described above to collectively form the rib 5 having a circular annular shape. The annular rib 5 including the annular rib segment 5*b* has a circular shape having a center of a diameter thereof at the same position as that of a center of an inner diameter of the insertion portion 4. The rib 5 is formed of a circle equidistant from an outer periphery of the insertion portion 4. The rib 5 including the annular rib segment 5*b* also achieves an effect equivalent to that achieved in each of the other embodiments.

The pump housing 6 has a space serving as a rotor chamber 61 at a position corresponding to a side surface of the rotor chamber 11 of the pump cover A. The rotor chamber 61 contains the rotor 7 in association with the side surface of the rotor chamber 11 of the pump cover A. In addition, in the pump housing 6, an inlet port and an outlet port which have shapes equal to those of the inlet port 21 and the outlet port 22 of the pump cover A may also be formed at positions corresponding to the inlet port 21 and the outlet port 22. As described above, the pump housing 6 may be formed integrally with the engine casing 9 and, since the engine casing 9 is made of a metal, the pump housing 6 is also made of the metal. The pump housing 6 also has the insertion portion 4 through which the drive shaft 8 is inserted.

When the rotor 7 is configured to be completely contained in the rotor chamber 61 of the pump housing 6 in the axial direction thereof, the rotor chamber 11 of the pump cover A may also have a range in which the rotor 7 is contained. In this case, the rotor chamber 11 of the pump cover A may also be a planar surface. The rotor 7 is configured to be contained in the rotor chamber 11 of the pump housing 6 and rotate to perform a pumping operation. Specifically, the rotor 7 is of an internal gear type such as, e.g., a trochoid type which includes an inner rotor 71 having a trochoid tooth form and an outer rotor 72 (see FIG. 4).

When the rotor 7 is configured to be completely contained in the rotor chamber 61 of the pump housing 6 in the axial direction thereof, the rotor chamber 11 of the pump cover A may also have a range in which the rotor 7 is contained. In this case, the rotor chamber 11 of the pump cover A may also be a planar surface. In addition, the inner rotor 71 is rotated by the drive shaft 8, while the outer rotor 72 can rotate with the inner rotor 71. The inner rotor 71 is rotated with an outer tooth thereof being engaged with an inner tooth of the outer rotor 72 to rotate the outer rotor 72 and allow the oil to be transported from the inlet port 21 to the outlet port 22.

Figure 5:
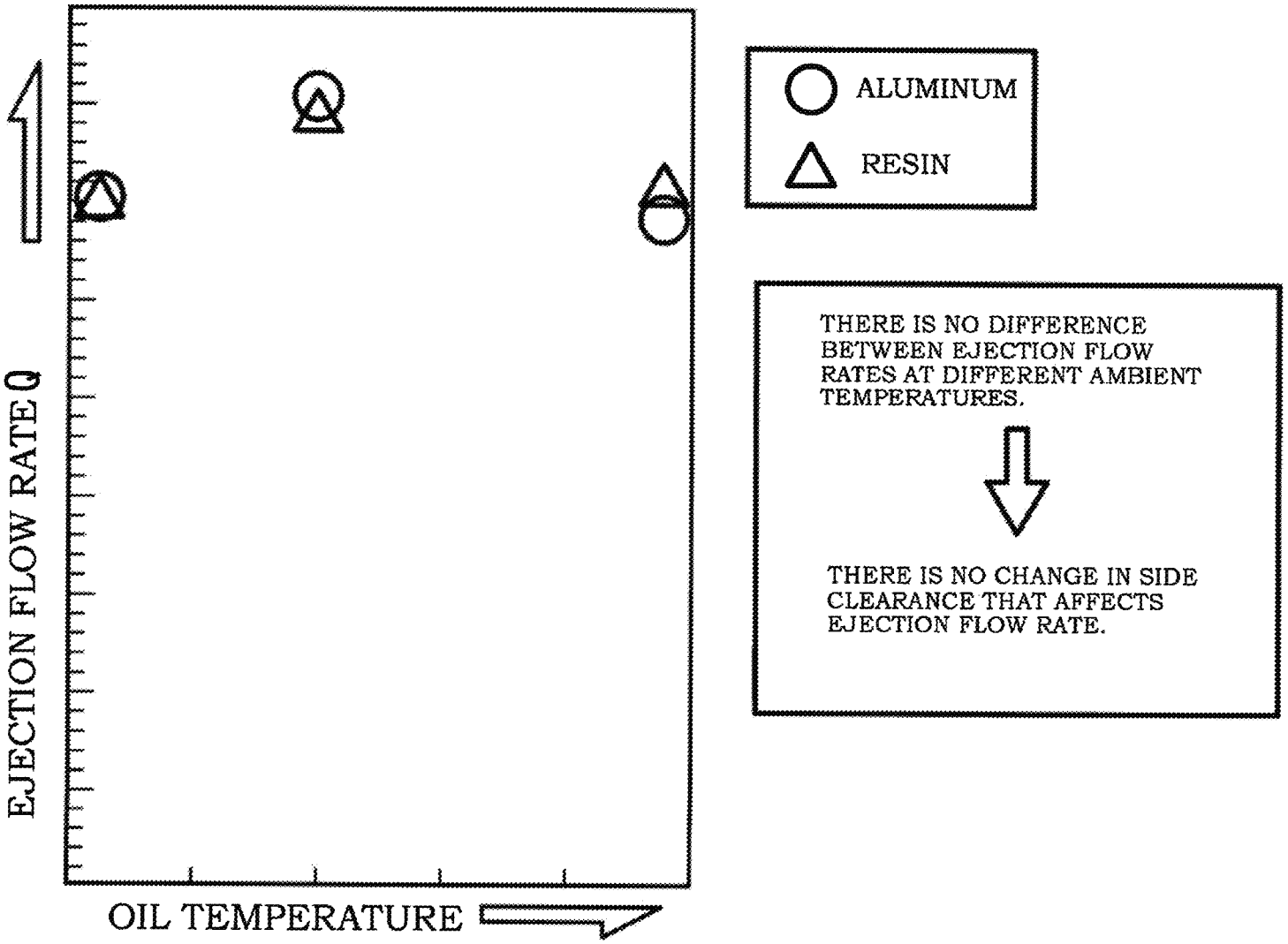
FIG. 5 is a graph illustrating characteristics of the present invention.
Figure 6:
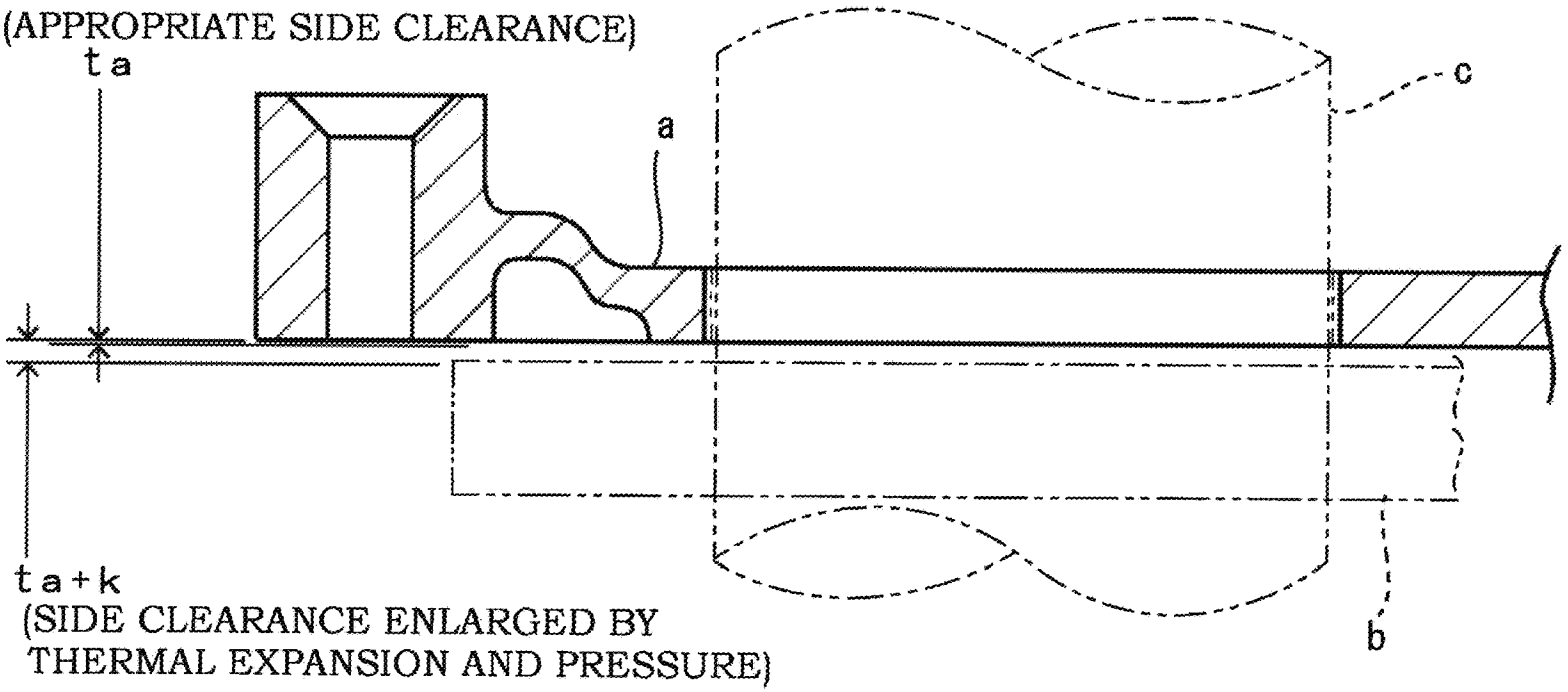
FIG. 6 is an enlarged cross-sectional view of a main portion illustrating a related art technique.

In the present invention, in the pump cover A made of the resin, the rib 5 is provided to be able to prevent the side clearance from being enlarged. FIG. 5 comparatively illustrates a case where the pump cover A in the present invention is made of a resin and a case where the pump cover A is made of a metal (aluminum). The illustrated graph indicates that, in the pump cover A made of the resin in the present invention, an amount of deformation can be reduced to a value substantially equivalent to that of an amount of deformation undergone by the pump cover A made of the metal. This allows the side clearance between the rotor 7 and a pump cover B to maintain the appropriate gap t, can maintain the rotor 7 in an excellent rotating state, and can improve the pump efficiency.

In the second embodiment, the rib is formed along a shape of the outlet port described above to receive a force exerted by the oil on the outlet port side on which the oil pressure is particularly high and be able to prevent the pump cover from being deformed.

In the third embodiment, the rib is formed on a portion corresponding to a range disposed at a radial middle portion (including also a periphery of the middle portion) of the outlet port and extending along the direction of the rotation of the rotor to the vicinity of the terminal end of the outlet port or to the vicinity of the beginning end of the inlet port. Consequently, the rib extends to a position corresponding to a seal land (partitioning portion) which is affected, together with the outlet port, by the high pressure of the oil. This allows the pump cover to more reliably maintain the shape.

In the fourth embodiment, the rib is disposed at a radial middle portion (including also the periphery of the middle portion) of the outlet port and formed to extend gradually away from the periphery of the insertion portion through which the drive shaft is inserted, and a portion thereof extending away is linearly configured. As a result, it is possible to respond to a variation of the pressure of the oil in the outlet port and uniformize an external pressure exerted on the rib. In each of the fifth, sixth, seventh, and eighth embodiments, the auxiliary rib is formed on an outer or inner peripheral side of the rib to be radially spaced apart by a predetermined distance from the rib. This allows each of the rib and the auxiliary rib to individually absorb the external force, can reduce the height of the rib from the outer surface, and can reduce a size of a projection of the outer surface of the pump cover.

What is claimed is:

1. An oil pump comprising:

a rotor;

a drive shaft that drives the rotor to rotate;

a rotor chamber in which the rotor is contained;

an inlet port and an outlet port each provided in the vicinity of the rotor chamber; and a pump cover, wherein the pump cover is made of a resin, and on a portion of an outer surface side of the pump cover corresponding to the outlet port, a rib that has an erecting wall shape is provided, and on a portion of an outer surface side of the pump cover corresponding to the inlet port, a rib that has an erecting wall shape is not provided.

2. The oil pump according to claim 1, wherein the rib is formed along a shape of the outlet port.

3. The oil pump according to claim 1, wherein the rib is formed on the portion corresponding to a range disposed at a radial middle portion of the outlet port and extending, along a direction of the rotation of the rotor, to the vicinity of a terminal end of the outlet port or to the vicinity of a beginning end of the inlet port.

4. The oil pump according to claim 1, wherein the rib is formed to extend gradually radially away from a periphery of an insertion portion which is disposed at a radial middle portion of the outlet port and through which the drive shaft is inserted, and a portion of the rib extending away has a linear shape.

5. The oil pump according to claim 1, wherein, on an outer peripheral side or an inner peripheral side of the rib, an auxiliary rib having a length, in a direction of the rotation, which is shorter than that of the rib is formed to be radially spaced apart by a predetermined distance from the rib.

6. The oil pump according to claim 2, wherein, on an outer peripheral side or an inner peripheral side of the rib, an auxiliary rib having a length, in a direction of the rotation, which is shorter than that of the rib is formed to be radially spaced apart by a predetermined distance from the rib.

7. The oil pump according to claim 3, wherein, on an outer peripheral side or an inner peripheral side of the rib, an auxiliary rib having a length, in the direction of the rotation, which is shorter than that of the rib is formed to be radially spaced apart by a predetermined distance from the rib.

8. The oil pump according to claim 4, wherein, on an outer peripheral side or an inner peripheral side of the rib, an auxiliary rib having a length, in a direction of the rotation, which is shorter than that of the rib is formed to be radially spaced apart by a predetermined distance from the rib.

9. The oil pump according to claim 1, wherein the rib that has an erecting wall shape is absent from the portion of the outer surface side of the pump cover corresponding to the inlet port.

10. The oil pump according to claim 2, wherein the rib that has an erecting wall shape is absent from the portion of the outer surface side of the pump cover corresponding to the inlet port.

* * * * *